US009212854B2

(12) United States Patent
Krantz

(10) Patent No.: US 9,212,854 B2
(45) Date of Patent: Dec. 15, 2015

(54) PLATE AND GASKET FOR A PLATE HEAT EXCHANGER

(75) Inventor: Joakim Krantz, Eslöv (SE)

(73) Assignee: ALFA LAVAL CORPORATE AB, Lund (SE)

( * ) Notice: Subject to any disclaimer, the term of this patent is extended or adjusted under 35 U.S.C. 154(b) by 464 days.

(21) Appl. No.: 13/133,413

(22) PCT Filed: Nov. 26, 2009

(86) PCT No.: PCT/SE2009/051340

§ 371 (c)(1),
(2), (4) Date: Jul. 7, 2011

(87) PCT Pub. No.: WO2010/071551

PCT Pub. Date: Jun. 24, 2010

(65) Prior Publication Data

US 2011/0259561 A1 Oct. 27, 2011

(30) Foreign Application Priority Data

Dec. 16, 2008 (SE) ..... 0850140

(51) Int. Cl.
*F28F 3/10* (2006.01)
*F28F 3/04* (2006.01)
(Continued)

(52) U.S. Cl.
CPC . *F28F 3/10* (2013.01); *F28F 3/046* (2013.01); *F28F 3/083* (2013.01); *F28D 9/005* (2013.01); *F28F 2275/085* (2013.01)

(58) Field of Classification Search
CPC ..... F28F 3/08; F28F 3/10; F28F 3/12; F28F 3/046; F28F 3/083
USPC ..... 165/166, 167, 168, 170; 277/630, 637
See application file for complete search history.

(56) References Cited

U.S. PATENT DOCUMENTS 2,676,000 A * 4/1954 Ekwall ..... 165/167
2,705,617 A * 4/1955 Ekwall ..... 165/181
(Continued)

FOREIGN PATENT DOCUMENTS

CN 2139257 Y 7/1993
CN 1145008 C 4/2004
(Continued)

OTHER PUBLICATIONS

Official Grant on Decision for Russian Application No. 2011129630 dated Nov. 2, 2012 with English translation.
(Continued)

*Primary Examiner* — Judy Swann
*Assistant Examiner* — John Higgins
(74) *Attorney, Agent, or Firm* — Buchanan Ingersoll & Rooney PC

(57) ABSTRACT

The invention relates to a heat exchanger plate for a plate heat exchanger, whereby the heat exchanger plate has a number of ports, distribution regions, adiabatic regions, a heat transfer region, and an edge region which extends outside the ports and the regions, whereby the heat exchanger plate includes a gasket groove extending in the edge region outside the regions and round the ports, whereby the gasket groove accommodates a gasket for sealing abutment against an adjacent heat exchanger plate in the plate heat exchanger where the gasket groove creates at least a recess of the heat transfer region along each side of the heat transfer region and that the recess enables a clip-on tab to be securely fastened to an edge region of the heat exchanger plate at the recess.

16 Claims, 6 Drawing Sheets

(51) Int. Cl.
*F28F 3/08* (2006.01)
*F28D 9/00* (2006.01)

(56) References Cited

U.S. PATENT DOCUMENTS

| | | | | | |
|---|---|---|---|---|---|
| 4,298,061 | A | | 11/1981 | Hoeffken | |
| 4,377,204 | A | * | 3/1983 | Johansson | 165/166 |
| 4,635,715 | A | | 1/1987 | Andersson | |
| 4,995,455 | A | | 2/1991 | Mathur | |
| 5,070,939 | A | | 12/1991 | Mathur | |
| 5,178,212 | A | | 1/1993 | Nakamura | |
| 5,727,620 | A | * | 3/1998 | Schaufele et al. | 165/166 |
| 5,887,650 | A | * | 3/1999 | Yang | 165/166 |
| 5,927,395 | A | | 7/1999 | Damiani | |
| 6,935,415 | B1 | * | 8/2005 | Petersen et al. | 165/166 |
| 2008/0196873 | A1 | * | 8/2008 | Svensson | 165/167 |

FOREIGN PATENT DOCUMENTS

| | | | |
|---|---|---|---|
| DE | 830 454 | | 2/1952 |
| EP | 0 134 155 | A1 | 3/1985 |
| EP | 450188 | A1 | 10/1991 |
| GB | 668905 | A | 3/1952 |
| GB | 678 333 | | 9/1952 |
| GB | 1 101 988 | A | 2/1968 |
| JP | 64-28495 | | 1/1989 |
| JP | 04-217794 | A | 8/1992 |
| JP | 06-040682 | U | 5/1995 |
| JP | 2003-502611 | | 1/2003 |
| JP | 2008-528927 | | 7/2008 |
| NL | 71993 | | 2/1953 |
| SU | 1430716 | | 10/1988 |
| SU | 1726965 | | 4/1992 |
| WO | WO9967589 | A2 | 12/1999 |
| WO | 00/77468 | | 12/2000 |
| WO | WO0077468 | A1 | 12/2000 |
| WO | WO2005045346 | A1 | 5/2005 |
| WO | 2006/080874 | | 8/2006 |
| WO | WO2007142592 | A1 | 12/2007 |

OTHER PUBLICATIONS

Office Action for Japanese Patent Application No. 2011-542060 dated Nov. 13, 2012 (in English).

English language Translation of First Office Action issued by Japanese Patent Office on Nov. 13, 2012 in Japanese Patent Application No. 2011-542060. (5 pages).

PCT/ISA/210 for International Application No. PCT/SE2009/051340 dated Sep. 8, 2011.

PCT/ISA/237 for International Application No. PCT/SE2009/051340 dated Sep. 8, 2011.

English language Translation of First Office Action issued by the State Intellectual Property Office of the People's Republic of China on Nov. 21, 2012 in Chinese Patent Application No. 200980151599.6. (4 pages).

International-Type Search Report issued by the Swedish Patent Office on Jun. 11, 2009 in National Application No. 0850140-5 (International-type Search Request No. ITS/SE08/00465). (5 pages).

* cited by examiner

PLATE AND GASKET FOR A PLATE HEAT EXCHANGER

AREA OF INVENTION

The present invention refers generally to plate heat exchangers allowing a heat transfer between two fluids at different temperature for various purposes. Specifically, the invention relates to a heat exchanger plate and to a gasket for the heat exchanger plate and a plate heat exchanger comprising the heat exchanger plate and the gasket according to the invention.

BACKGROUND OF INVENTION

Plate heat exchangers provided with gaskets normally comprise a plate package of heat exchanger plates disposed adjacent to one another. Gaskets are disposed between the heat exchanger plates. The plate package may also formed by heat exchanger plates that are permanently joined together in pairs to form so-called cassettes, e.g. by welding or brazing, with gaskets placed between the respective cassettes. The gaskets are accommodated in gasket grooves formed during the form-pressing of the heat exchanger plates. Plate heat exchangers further comprise inlet and outlet ports, which extend through the plate package, for two or more media.

Heat exchanger plates are normally made by form-pressing of sheet metal and are disposed in the plate package in such a way as to form first plate intermediate spaces, which communicate with the first inlet port and the first outlet port, and second plate intermediate spaces which communicate with the second inlet port and the second outlet port. The first and second plate intermediate spaces are disposed alternately in the plate package.

The design of heat exchanger plate for plate heat exchangers aims to use as much as possible of heat transfer or heat exchange area for the heat exchange between two or more media, but it also needs take in account how the gasket can be applied on the heat exchanger plate to be securely fastened and to fulfil its seal functionality.

Different designs of the heat exchanger plate and the associated gasket are known in the art. E.g. is a plate heat exchanger known from U.S. Pat No. 5,070,939, where the heat exchanger plate is provided with a gasket groove having a corresponding gasket with nubs which glued to the gasket groove. The nubs serving as indicators of where the glue should applied. In another prior art document, GB-A-668905, the heat transfer area has been alternately retracted along the transport direction to create increased turbulence of the media. In U.S. Pat No. 5,927,395, WO-A1-00/77468 and WO-A1-2005/045346 are shown other solutions on how to fasten the gasket to the heat exchanger plate by clamping the gasket around the plate edge and by forming the gasket groove.

The drawbacks with the above solutions are that they require a lot area along the heat exchanger plate edges to be applied and thereby the potential heat exchange area is reduced. Further the design of the clamping means is rather complicated.

DISCLOSURE OF INVENTION

The object of the invention is to provide an improved heat exchanger plate and to prevent or at least reduce the disadvantages indicated above and to provide a better solution for a heat exchanger plate which comprises a gasket and a gasket groove. Particular aims are a new and better heat exchanger plate and a gasket which enables optimum utilisation of the plate's heat transfer region and thereby results in better plate heat exchanger performance with a given number of plates.

This object is achieved according to the invention by the heat exchanger plate for a plate heat exchanger as indicated in the introduction which is characterised in that the gasket groove includes at least an recess of the heat transfer region along each side of the heat transfer region and that the recess enables a clip-on tab to be secure fasten to edge region of the heat exchanger plate at the recess.

The invention makes it possible to provide a heat exchanger plate where a larger proportion of the plate's surface can be utilised for heat transfer.

According to an embodiment of the invention, the recesses along each side of the heat transfer region are arranged on corresponding locations and that the recesses along each side of the heat transfer region are arranged at equal distance relatively to each other, or at equal distance to a horizontal centre line.

According to a further embodiment of the invention, the edge region is broader at the recess along the heat transfer region than the remaining edge region along the heat transfer region.

According to yet an embodiment of the invention, the recess is provided with an upper clip-on tab position and a lower clip-on tab position to enable the clip-on tab to be alternatively received in two different positions of the recess.

According to still another embodiment of the invention, two heat exchanger plates are permanently joined together as a pair to form a cassette. The cassettes have gaskets disposed between them for sealing abutment against an adjacent cassette in the plate heat exchanger. The heat exchanger plates are joined together in pairs by welding to form cassettes.

Another object with the present invention is to provide a gasket adapted to the design of the heat exchanger plate according to the invention.

This object is achieved according to the invention by a gasket provided with clip-on tabs that is fasten the gasket to the heat exchanger plate at the recesses of the gasket groove, and also provided with clip-on tabs to fasten the gasket to the heat exchanger plate close to the ports of heat exchanger plate.

According to an embodiment of the invention, the clip-on tabs are arranged to be received alternately in the upper and lower clip-on tab positions, respectively, in corresponding recesses on each side of the heat exchanger plate. The gasket is made of a rubber or polymer material.

Yet another object with the present invention is to provide a plate heat exchanger including a package of heat exchanger plates and gaskets.

The invention makes it possible to produce a heat exchanger of increased performance. The number of plates can be reduced while maintaining the same capacity, resulting in cost savings on both material and space. Since many applications, e.g. those for aggressive media, involve very expensive material, the heat transfer capacity and hence the number of heat exchanger plates are of crucial cost significance. It is not unusual for a plate heat exchanger to comprise up to a thousand heat exchanger plates, which means that even a seemingly slight capacity improvement of a heat exchanger plate and a plate heat exchanger according to the invention may have a very large impact on profitability.

Further aspects of the invention are defined in the dependent claims.

BRIEF DESCRIPTION OF THE DRAWINGS

The present invention is now to be explained more closely by means of a description of various embodiments and with reference to the drawings attached hereto.

DETAILED DESCRIPTION OF EMBODIMENTS

Heat exchangers are used for transferring heat between two fluids separated by a solid body. Heat exchangers can be of several types, the most common are spiral heat exchangers, tubular heat exchangers and plate heat exchangers. Plate heat exchangers are used for transferring heat between a hot and a cold fluid that are flowing in alternate flow passages formed between a set of heat exchanger plates. The arrangement of heat exchanger plates defined above is enclosed between end plates that are relatively thicker than the heat exchanger plates. The inner surface of each end plate faces the heat transfer plates.

Figure 1:
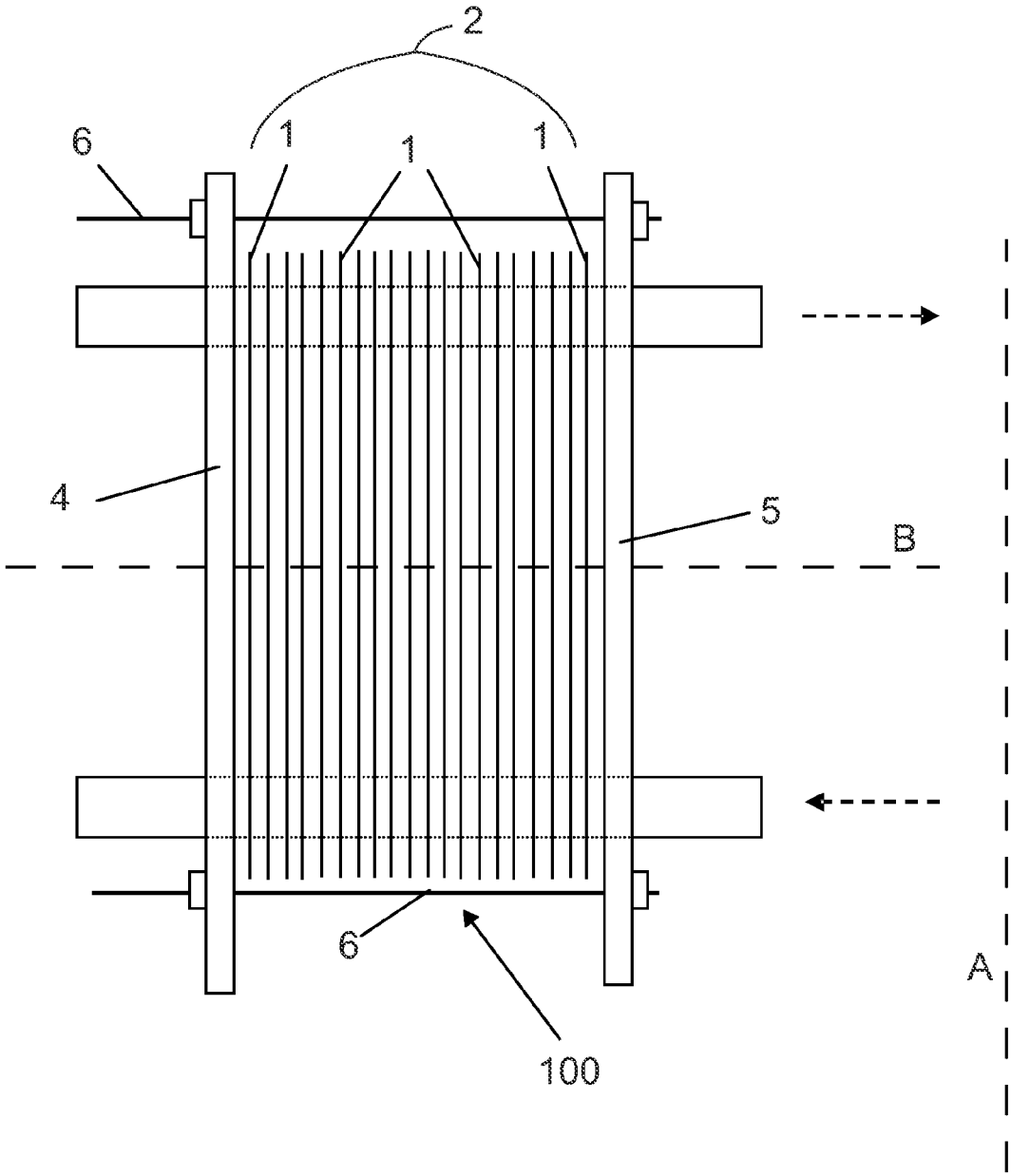
FIG. 1 discloses a side view of a plate heat exchanger.

FIG. 1 discloses a schematic view of a plate heat exchanger 100 comprising a number of compression-molded heat exchanger plates 1, which heat exchanger plates 1 are provided in parallel to each other and successively in such a way that they form a plate package 2. The plate package 2 is provided between a first end plate 4, also called frame plate, and a second end plate 5, also called pressure plate. Between the heat exchanger plates 1, first plate interspaces and second plate interspaces are formed. The end plates 4 and 5 are pressed against the plate package 2 and against one another by tightening bolts 6, which extend through the end plates 4 and 5.

The plate heat exchanger 100 comprises a first inlet port and a first outlet port for a first medium, and a second inlet port and a second outlet port for a second medium. The inlet and outlet ports extend through the one end plate 4 and the plate package 2. It is of course also possible for the inlet and outlet ports to be disposed on both sides of the plate heat exchanger 100, i.e. on both end plates 4 and 5. The two medium may be led in the same or in opposite directions relative to one another.

The heat exchanger plate 1 is designed in such a way that one plate type is enough to assemble a plate heat exchanger 100. Thus, every other heat exchanger plate 1 is turned upside down with respect to a horizontal axis (B) in order to obtain the different flow channels when the plate heat exchanger 100 is assembled. In this way, the pattern of the heat exchanger plates will interact such that the pattern of one heat exchanger plate 1 will bear on the pattern of the other heat exchanger plate 1, creating a plurality of intermediate contact points.

Figure 2:
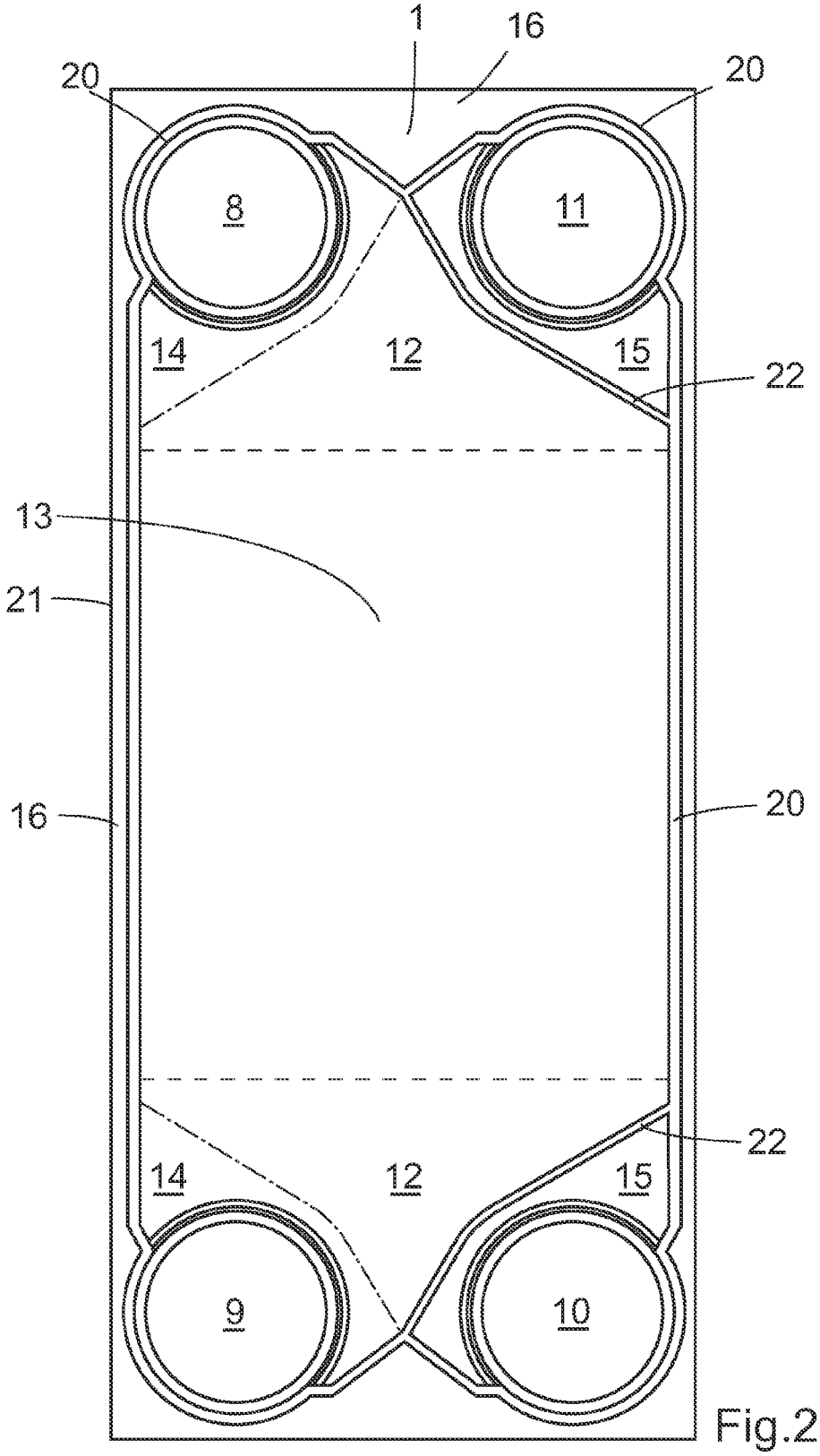
FIG. 2 shows a schematic front view of a heat exchanger plate.

FIG. 2 shows a schematic view of a heat exchanger plate 1 made of form-pressed sheet metal, e.g. stainless steel, titanium or some other material suitable for the application. As described above the heat exchanger plate 1 further comprises upper and lower distribution regions 12 and, between them, a heat transfer region 13. A first so-called adiabatic region 14 is disposed at the ports 8 and 9, and a second adiabatic region 15 at the ports 10 and 11. There is an edge region 16 outside and round the ports 8-11 and the regions 12, 13, 14 and 15.

All of said regions 12-15 are provided with a corrugation of ridges and valleys. The pattern of each region may vary depending on its particular purpose, i.e. whether it is a distribution region 12, a heat transfer region 13 or an adiabatic region 14, 15. One common pattern design is a so called chevron or fish-bone pattern, in which the corrugations display one or more direction changes. A simple form of the chevron shaped pattern is a V-shape. In the shown examples, the corrugated pattern comprises straight longitudinal corrugations. The pattern of the corrugated surface, i.e. the ridges and valleys, are angled with respect to a longitudinal axis of the heat exchanger plate 1. Depending on the used pattern, the pattern may or may not be mirror-inverted with respect to horizontal axis of the heat exchanger plate 1. The areas of the plate outside of the heat transfer region 13, i.e. the upper and lower distribution regions 12, is in the shown examples always mirror-inverted.

The heat exchanger plate 1 has in the shown embodiment four ports 8-11 extending through the heat exchanger plate 1. The ports 8-11 are normally each situated in the vicinity of their respective corner portion of the heat exchanger plate 1, but other positioning of the ports 8-11 is also possible within the scope of the invention.

The heat exchanger plates 1 in the shown embodiment are disposed in such a way in the plate package 2 as to form first plate intermediate spaces which communicate with the first inlet port 8 and the first outlet port 9, and second plate intermediate spaces, which communicate with the second inlet port 10 and the second outlet port 11. The first and second plate intermediate spaces are disposed alternately in the plate package 2. The separation of the plate intermediate spaces may be by gaskets 30 extending in gasket grooves 20, 22 formed during the form-pressing of the heat exchanger plates 1. The gasket 30 is usually made of a rubber or polymer material.

In FIG. 2 it is shown how a first gasket groove 20 of a heat exchanger plate 1 extends along the plate edge 21 around the heat transfer region 13, the distribution region 12, the first and second adiabatic regions 14, 15 and round the ports 8-11. A second gasket groove 22 extends diagonally between the second adiabatic region 15 and the adjacent distribution region 12. To make it possible to utilise the maximum possible amount of the heat transfer region 13, it is desirable to be able to position the gasket groove 20 as near as possible to the plate edge 21. A limiting factor, however, is that the edge region 16 has for strength reasons to be provided with a wavelike corrugation pattern with ridges and valleys which form a number of so-called nibs which occupy a certain minimum surface of the edge region 16. There has therefore to be at least a certain minimum distance between the plate edge 21 and the gasket groove 20.

Another limiting factor that needs to take in account is how the gasket 30 can be applied on the heat exchanger plate 1 to be securely fastened and to fulfil its seal functionality. The best way of securely fastened the gasket 30 to the heat exchanger plate 1, but also enable easy replacement of the gasket 30, is to use clip-on tabs arranged along the gasket 30. An example of such a clip-on provided gasket is shown the design registration EU 000788674-0001. The clip-on tab is folded around the plate edge 21 to fasten the gasket to the heat exchanger plate 1. An alternative method to fasten the gasket 30 to heat exchanger plate 1 is to use glued gaskets. Many times a combination is used having a gasket provided with clip-on tabs which is glued onto the heat exchanger plate.

To achieve an optimized solution having as large heat transfer surface as possible and still having the stability of the plate edge and the possibility to fasten the gasket securely, the heat transfer region 13 has been provided with local indentation or recesses 40 of the gasket groove 20 into the heat transfer region 13, see FIGS. 3-6, to enable the use of a gasket 30 having clip-on tabs 41 and receive maximum heat transfer region 13. On the heat exchanger plate 1 of FIG. 3 there has been provided five recesses 40 of the heat transfer region 13 along each plate edge 21, but there can be more or fewer depending on the length of the heat exchanger plate 1. The number of recesses 40 and corresponding clip-on tabs 41 is adjusted to ensure that the gasket 30 is securely fastened.

Figure 5:
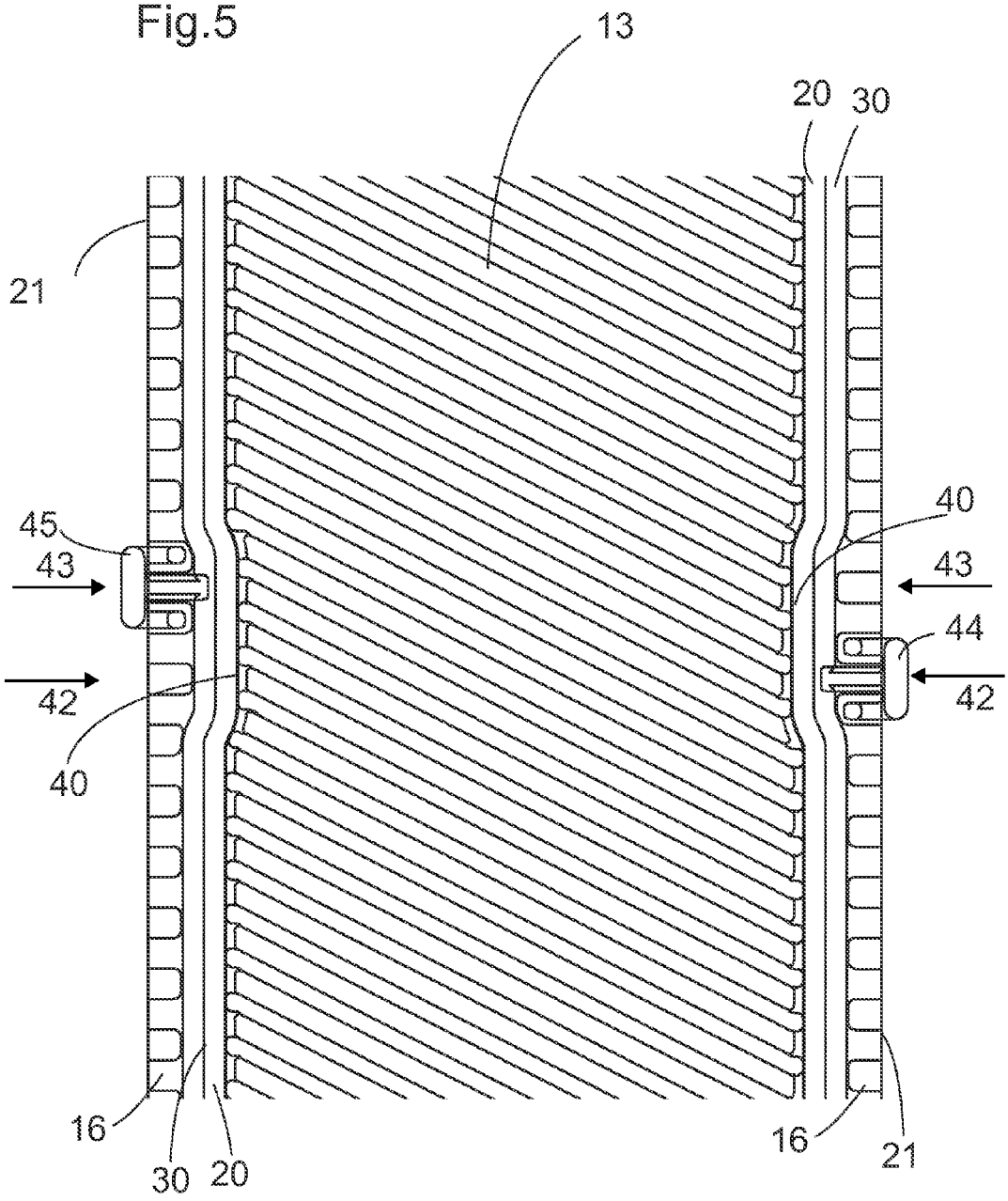
FIG. 5 discloses a second partial detailed view of a heat exchanger plate according to an embodiment of the invention.

Since only one type of heat exchanger plate 1 is used in the plate heat exchanger 100, it is essential that the clip-on tabs 41 are not located on corresponding positions on the plate edge 21, i.e. clip-on tabs are not mirrored in respect of the longitudinal center line A of the heat exchanger plate 1. See FIGS. 3 and 5. To make the assembly of the gasket onto heat exchanger plate 1 fairly easy the recesses 40 are designed so that the clip-on tab 41 can be mounted two different positions, a lower position 42 and an upper position 43. In FIG. 5 the right clip-on tab 44 has been mounted in the lower position 42 and the left clip-on 45 tab has been mounted in the upper position 43. Also in FIG. 3 it is shown that the clip-on tabs 41 are mounted in alternately in lower and upper positions 42, 43.

Figure 6:
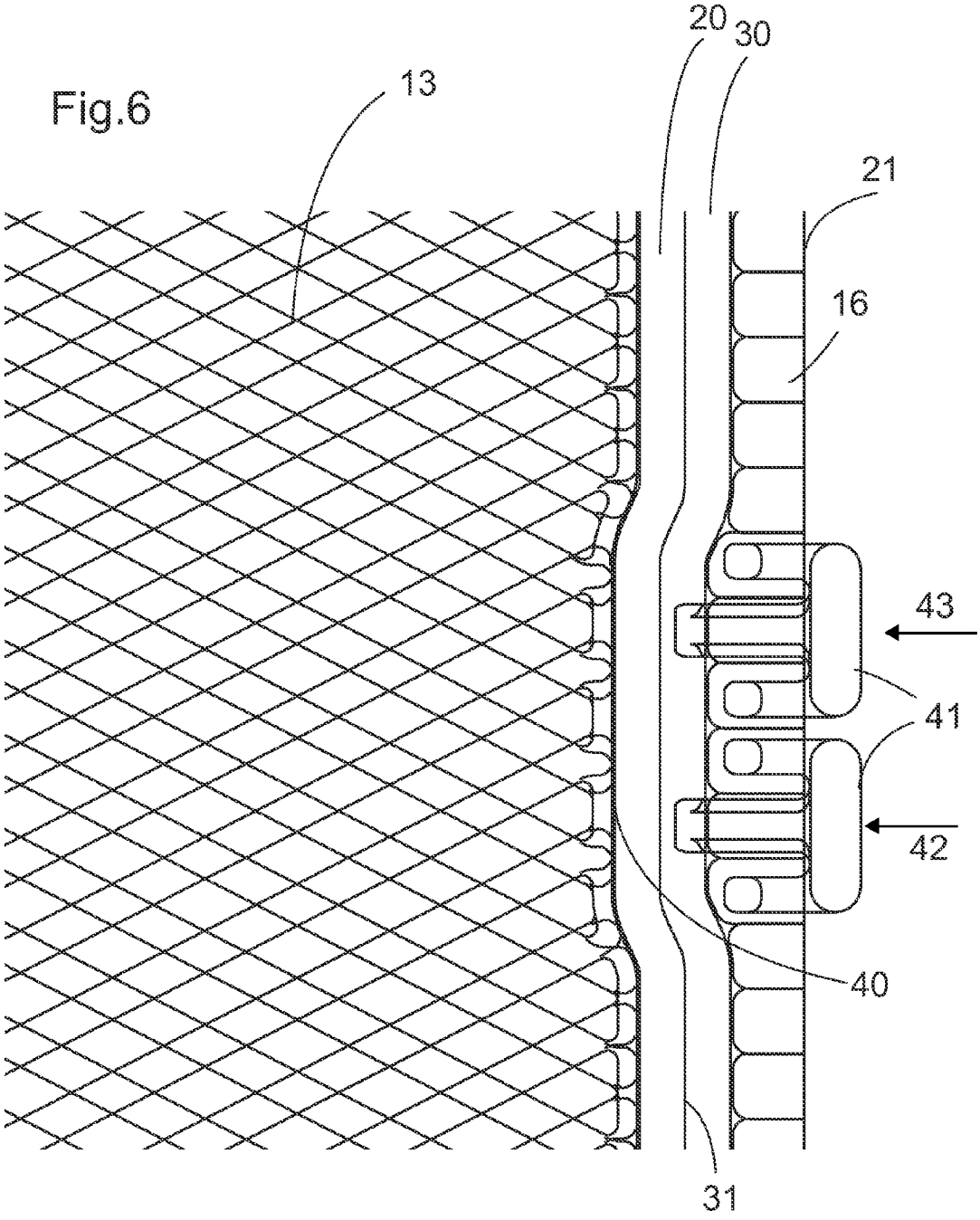
FIG. 6 discloses a third partial detailed view of a heat exchanger plate according to an embodiment of the invention, where two heat exchanger plates are placed on top of each other.

In FIG. 6 is shown a partial detailed view, where two heat exchanger plates 1 are placed on top of each other. To facilitate the understanding the heat exchanger plates 1 are transparent. The clip-on tabs 41 of the two heat exchanger plates 1 are located beside each other as they have been mounted in different position 42, 43 of the recess 40. If the clip-on tabs 41 had been mounted in the same positions 42, 43 of the recess 40 the clip-on tabs 41 would have been placed on top of each other, thus the assembly of the plate heat exchanger 100 would not have been successful.

Figure 3:
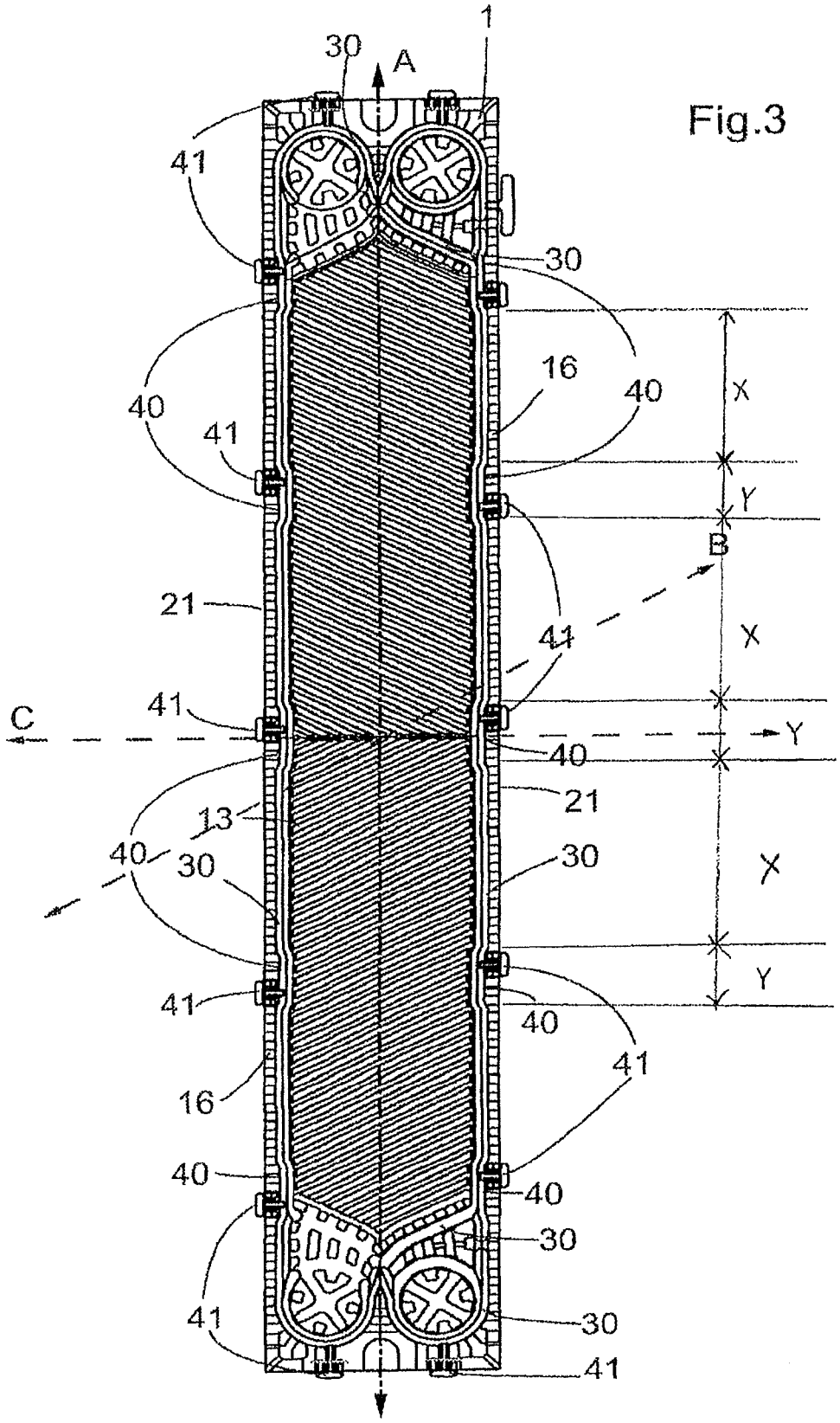
FIG. 3 discloses a front view of a heat exchanger plate according to an embodiment of the invention.

The distance between the recesses 40 along each side of the heat transfer region 13 is preferably equal as shown in FIG. 3, but the distance between the recesses 40 might also varying as along as the distance between recess and a horizontal centre line C in the middle of the heat exchanger plate 1 for corresponding recesses 40 are equal. Thereby it is possible to turn the adjacent heat exchanger plates 180 degrees relative to the horizontal axis B and still match the clip-on tabs 41 and the recesses 40 of the adjacent heat exchanger plates, independent of the distance between adjacent recesses 40.

The capacity of the heat exchanger plate 1 and the plate heat exchanger 100 will thus be greater since the heat transfer region 13 can be enlarged and fewer plates need be used for achieving desired performance. The result is a great saving of material costs.

Figure 4:
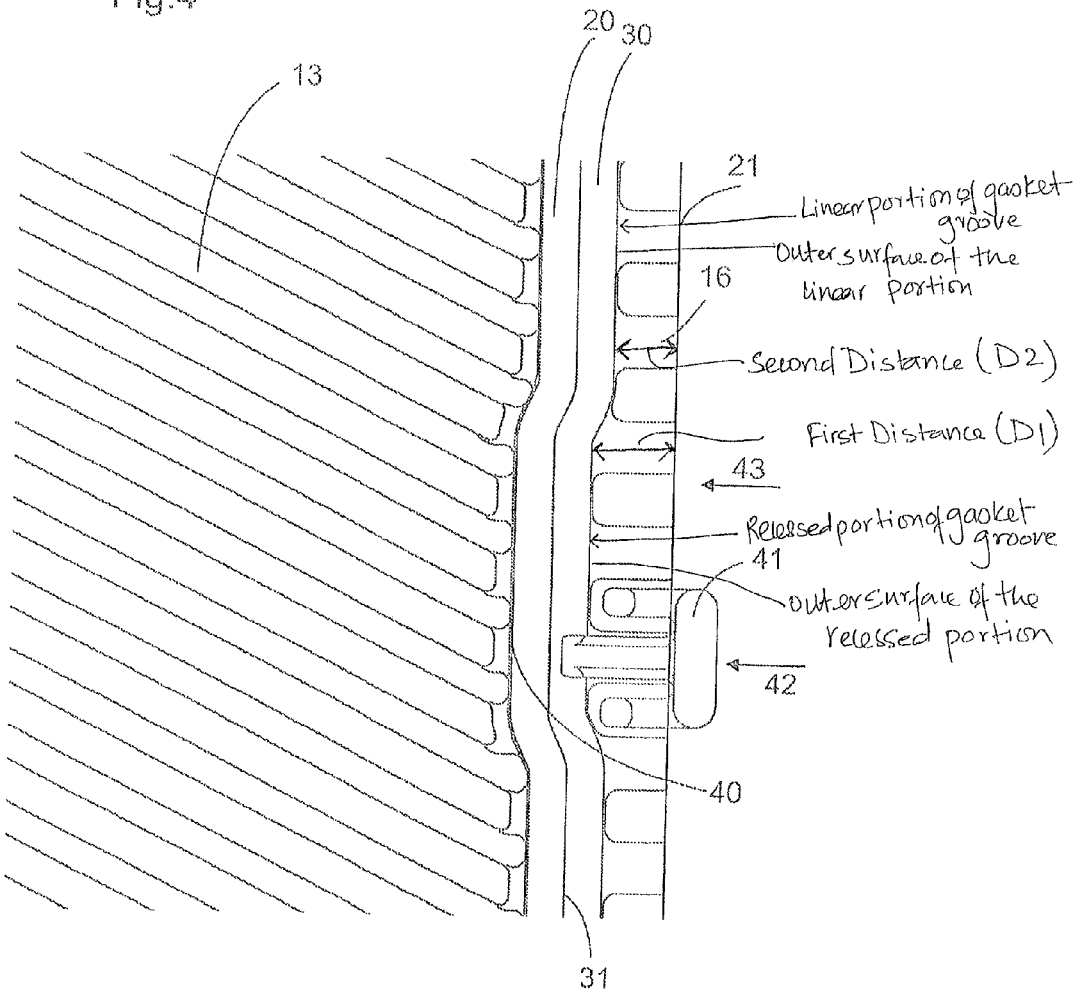
FIG. 4 discloses a first partial detailed view of a heat exchanger plate according to an embodiment of the invention.

In FIGS. 4-6 it might be interpreted as if the gasket 30 does not fill out the entire gasket groove 20, but it does. The gasket 30 is provided with a centre ridge 31 (shown in FIG. 4). The gasket 30 is also received in gasket grooves 20 and 22 around the ports and in the adjacent adiabatic and distribution regions.

In the shown examples the gasket grooves and the local displacements of the gasket groove has been described in connection with heat exchanger plates that are arranged in a plate package having gaskets between every heat exchanger plate, but it is also arrange gasket groove displacement when two heat exchanger plates are joined together permanently as a pair to form a cassette, e.g. by welding. Gaskets are with advantage disposed between adjacent cassettes.

The invention is not limited to the embodiments described above and shown on the drawings, but can be supplemented and modified in any manner within the scope of the invention as defined by the enclosed claims.

The invention claimed is:

1. A heat exchanger plate for a plate heat exchanger, the heat exchanger plate comprising:

a number of ports, distribution regions, adiabatic regions, a heat transfer region, and an edge region which extends outside the number of ports and also extends outside said distribution regions, the adiabatic regions and the heat transfer region, whereby the heat exchanger plate includes a gasket groove in the edge region outside said distribution regions, the adiabatic regions and the heat transfer region and around the number of ports, the gasket groove extending longitudinally along two opposite sides of the heat transfer region, whereby the gasket groove is configured to accommodate a gasket for sealing abutment against an adjacent heat exchanger plate in the plate heat exchanger, at least two portions of the gasket groove along each side of the heat transfer region being recessed toward the heat transfer region, which two recessed portions are separated by an intermediate portion, a longitudinal extent of each of said two recessed portions being less than a longitudinal extent of the intermediate portion, the edge region being provided, at the at least two portions of the gasket groove, with a corrugation pattern of ridges and valleys arranged to engage a clip-on tab comprised in the gasket to securely fasten the gasket to the heat exchanger plate.

2. A heat exchanger plate according to claim 1, the recesses along each side of the heat transfer region are arranged on corresponding locations.

3. A heat exchanger plate according to claim 2, the recesses along each side of the heat transfer region are arranged at equal distance relatively to each other.

4. A heat exchanger plate according to claim 2, the recesses along each side of the heat transfer region are arranged at equal distance relatively to a horizontal centre line.

5. A heat exchanger plate according to claim 1, the edge region is broader at the recesses along the heat transfer region than the remaining edge region along the heat transfer region.

6. A heat exchanger plate according to claim 1, the recess is provided with an upper clip-on tab position and a lower clip-on tab position to enable the clip-on tab to be alternatively received in two different positions of the recess.

7. Heat exchanger plates according to claim 1, two heat exchanger plates are permanently joined together as a pair to form a cassette.

8. Heat exchanger plates according to claim 7, the cassettes have gaskets disposed between them for sealing abutment against an adjacent cassette in the plate heat exchanger.

9. Heat exchanger plates according to claim 7, the heat exchanger plates are joined together in pairs by welding to form cassettes.

10. A plate heat exchanger including a package of heat exchanger plates and gaskets according to claim 1.

11. A heat exchanger plate for a plate heat exchanger, the heat exchanger plate comprising:

a plurality of ports, a plurality of distribution regions, a plurality of adiabatic regions, a heat transfer region and an edge region which extends outside the plurality of ports and also extends outside the distribution regions, the adiabatic regions and the heat transfer region; and a gasket groove in the edge region outside the distribution regions, the adiabatic regions and the heat transfer region and around the plurality of ports, the gasket groove extending longitudinally along two opposite sides of the heat transfer region;

the gasket groove being arranged to accommodate a gasket for sealing abutment against an adjacent heat exchanger plate in the plate heat exchanger, at least two portions of the gasket groove on each of the two opposite sides of the heat transfer region being recessed toward the opposite side of the heat transfer region, which two recessed portions are separated by an intermediate portion, a longitudinal extent of each of said two recessed portions being less than a longitudinal extent of the intermediate portion, the edge region being provided, at the at least two portions of the gasket groove, with a corrugation pattern of ridges and valleys arranged to engage a clip-on tab comprised in the gasket to securely fasten the gasket to the heat exchanger plate.

12. A heat exchanger plate according to claim 11, a plurality of spaced apart portions of the gasket groove on each of the two opposite sides of the heat transfer region are recessed toward the opposite side of the heat transfer region.

13. A heat exchanger plate according to claim 11, more than two spaced apart portions of the gasket groove on each of the two opposite sides of the heat transfer region are recessed toward the opposite side of the heat transfer region, the portions of the gasket groove on each of side of the heat transfer region being spaced apart at equal distances.

14. A heat exchanger plate according to claim 11, the edge region is broader at the recesses portions of the gasket groove than at remaining edge regions along the sides of the heat transfer region.

15. A heat exchanger plate according to claim 11, the edge region at the recessed portions of the gasket groove is provided with an upper clip-on tab position and a lower clip-on tab position to enable the clip-on tab to be alternatively received in two different positions of the recessed portions.

16. A heat exchanger plate for a plate heat exchanger, the heat exchanger plate possessing two oppositely disposed and longitudinally extending sides and two oppositely disposed and laterally extending sides, the longitudinally extending sides being longer than the laterally extending sides, the heat exchanger plate comprising:

a plurality of ports, a plurality of distribution regions, a plurality of adiabatic regions, a heat transfer region and an edge region which extends outside the plurality of ports and also extends outside the distribution regions, the adiabatic regions and the heat transfer region; and a gasket groove in the edge region outside the distribution regions, the adiabatic regions and the heat transfer region and around the plurality of ports, the gasket groove extending along the two longitudinally extending sides of the heat exchanger plate at opposite sides of the heat transfer region;

the gasket groove being arranged to accommodate a gasket for sealing abutment against an adjacent heat exchanger plate in the plate heat exchanger;

the gasket groove possessing linear portions along each of the longitudinally extending sides, the gasket groove also possessing recessed portions along each of the longitudinally extending sides, each of the linear portions along each longitudinally extending side being positioned between a respective pair of the recessed portions, the linear portions of the gasket groove and the recessed portions of the gasket groove each possessing an outer surface, the linear portions of the gasket groove which are positioned between a respective pair of the recessed portions each having a longitudinally extending length longer than a longitudinally extending length of each of the recessed portions between which the linear portion is positioned;

the outer surface of the recessed portions of the gasket groove on each of the two opposite sides of the heat transfer region being recessed toward the opposite side of the heat transfer region, the outer surface of each of the recessed portions of the gasket groove on one side of the heat transfer region being located at a first distance from the adjacent longitudinally extending side of the heat exchanger plate, the outer surface of each of the linear portions of the gasket groove on the one side of the heat transfer region being located at a second distance from the adjacent longitudinally extending side of the heat exchanger plate, the first distance being greater than the second distance; and the edge region being provided, at the recessed portion of the gasket groove, with a corrugation pattern of ridges and valleys arranged to engage a clip-on tab comprised in the gasket to securely fasten the gasket to the heat exchanger plate.

* * * * *